US006840808B2

(12) United States Patent
Ruckerbauer et al.

(10) Patent No.: US 6,840,808 B2
(45) Date of Patent: Jan. 11, 2005

(54) CONNECTOR FOR A PLURALITY OF SWITCHING ASSEMBLIES WITH COMPATIBLE INTERFACES

(75) Inventors: Hermann Ruckerbauer, Moos (DE); Maksim Kuzmenka, München (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/610,241

(22) Filed: Jun. 30, 2003

(65) Prior Publication Data

US 2004/0048518 A1 Mar. 11, 2004

(30) Foreign Application Priority Data

Jun. 28, 2002 (DE) ..... 102 29 119

(51) Int. Cl.[7] ..... H01R 13/68
(52) U.S. Cl. ..... 439/631; 439/325
(58) Field of Search ..... 439/631, 59, 325, 439/326, 327, 377, 637

(56) References Cited

U.S. PATENT DOCUMENTS

| | | | | |
|---|---|---|---|---|
| 4,322,120 A | * | 3/1982 | Rilling | 439/631 |
| 5,908,333 A | | 6/1999 | Perino et al. | |
| 6,042,386 A | | 3/2000 | Cohen et al. | |
| 6,086,427 A | | 7/2000 | Cahaly | |
| 6,273,759 B1 | | 8/2001 | Perino et al. | |

* cited by examiner

*Primary Examiner*—Truc T. Nguyen
*Assistant Examiner*—James R. Harvey
(74) *Attorney, Agent, or Firm*—Laurence A. Greenbe; Werner H. Stemer; Ralph E. Locher

(57) ABSTRACT

A connector is described for fixing a plurality of switching assemblies on a substrate. The connector is also for making contact with the plurality of switching assemblies, which have compatible interfaces. The connector has a plurality of receptacle devices with contact elements and internal contact connections between corresponding contact elements, as a result of which, the length of the connections between the switching assemblies is reduced, signal propagation times are shortened and a higher clock rate for operating the switching assemblies is made possible.

3 Claims, 4 Drawing Sheets

FIG. 4A
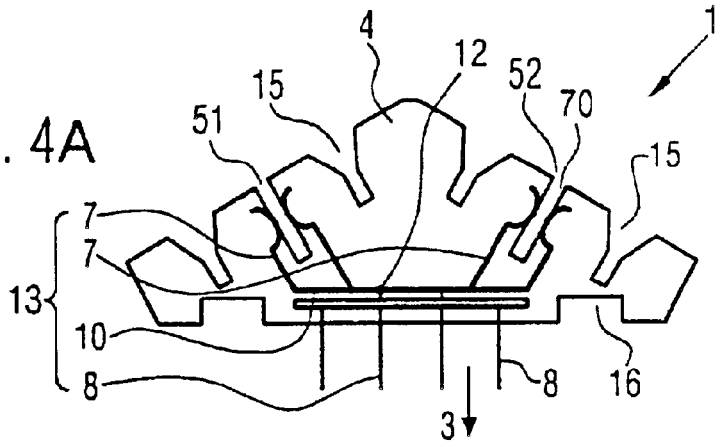
FIG. 4B
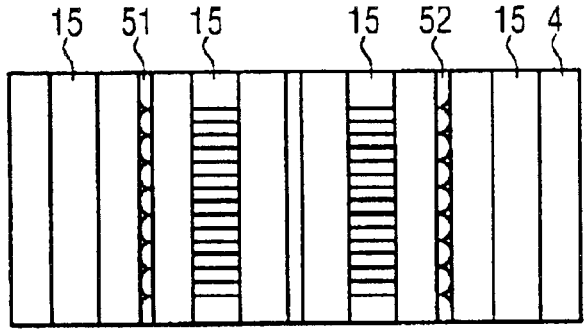
FIG. 5
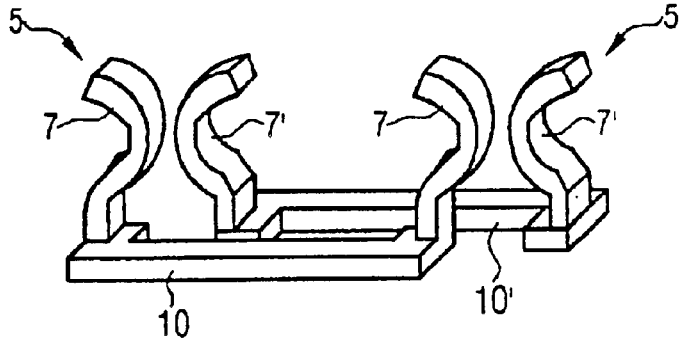
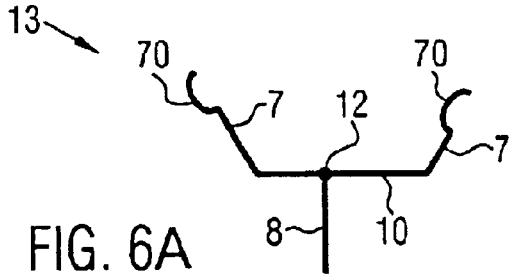
FIG. 6A
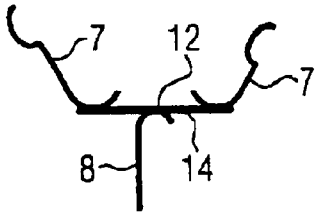
FIG. 6B

CONNECTOR FOR A PLURALITY OF SWITCHING ASSEMBLIES WITH COMPATIBLE INTERFACES

BACKGROUND OF THE INVENTION

Field of the Invention

The invention relates to a connector for fixing switching assemblies, which have contact areas and mutually compatible interfaces, on a substrate and for making contact with the switching assemblies. The connector includes an insulating body, and a plurality of receptacle devices formed in the insulating body. The receptacle devices are for configuring the switching assemblies. The connector has contact elements arranged at inner areas of the receptacle devices and opposite the respectively corresponding contact areas on the switching assemblies. The connector also has contact devices for electrically making contact with signal lines arranged on or in the substrate.

Modular electronic systems with a variable configuration are usually provided with a motherboard with one or a plurality of slots. Depending on the requirements made of the system or on the expansion level of the system, the slots are equipped with a respective modular component or remain vacant. In this case, the interfaces of the modular components are necessarily identical or mutually compatible. Beyond that, functional similarity of the modular components is not demanded. The modular components are, for instance, switching assemblies, such as, memory modules or interface modules.

The slots are usually formed as connectors fixed on a substrate, for instance, a motherboard. The connectors additionally produce in each case an electrical connection between signal lines on the substrate and contact areas on the switching assemblies.

The connectors enable simple exchange or simple retrofitting of switching assemblies.

A typical example of such a modular system is a computer system (personal computer, workstation, server) with expandable main memory slots for memory modules in the form of connectors provided on the motherboard and equipped with memory modules depending on the desired size of the main memory.

With higher clock and data transfer rates to and from the memory modules, there is a rise in the requirements made of the design of the signal lines of the bus system.

A bus system known as a RAMBUS system provides, for example, shielded or differential bus signals which are looped through by the virtually series-connected modules (up-down concept). With the RAMBUS system, substantially higher clock rates can be realized on the data bus at the expense of a significantly increased outlay on circuitry on the motherboard and the memory modules.

By contrast, a known type of DDRI system (double data rate) is a simple stub bus system with signal lines that are combined to form a main line and, proceeding from a bus control module on the motherboard, are generally led through under the memory modules to a termination on the motherboard. The termination limits signal reflections. Stubs lead from the main line of the bus system to the connectors with the memory modules (stub bus).

For higher clock rates, as are provided for DDRII systems, a termination is necessary at the end of each stub, that is to say at the bus control module and on each individual memory module, since, as the clock rate rises, the bus signals become more sensitive to reflections from a line end.

Generally, short signal lines, the lowest possible parasitic capacitances, inductances and resistances, and also the smallest possible number of reflection points in the course of the signal lines are necessary in order to ensure higher clock rates on the bus systems.

Therefore, there already exists (from the company FCI) a dual vertical DIMM connector having two receptacle devices (slots) for receiving 120-pole DIMMs. In this case, each contact element in the receptacle device is connected to a contact device on a mounting side of the connector. The contact devices on the mounting side of the connector are arranged as solder balls arranged offset in a grid structure (ball grid array). Combining two connectors to form a dual connector reduces the space requirement and increases the flexibility in routing the electrical connections on the main board.

The fashioning of the electrical signal lines between a bus control module, the connectors and possible terminations influences the signal quality on the signal lines and limits the maximum clock rate on the signal lines and thus the data transfer rate. Since it is foreseeable that both the computer system and the memory modules will need to be operated internally with higher data transfer rates, the maximum data transfer rate of the bus system itself increasingly limits the data transfer rate of a system.

SUMMARY OF THE INVENTION

It is accordingly an object of the invention to provide a configuration of the type mentioned in the introduction that overcomes the above-mentioned disadvantages of the prior art apparatus of this general type.

In particular, it is an object of the invention to provide a configuration that ensures a high data transfer rate to, from, and between switching assemblies mounted in connectors.

With the foregoing and other objects in view there is provided, in accordance with the invention, a connector for fixing and making contact with switching assemblies having contact areas and mutually compatible interfaces. The connector includes an insulating body and a plurality of receptacle devices for configuring the switching assemblies. The plurality of receptacle devices are formed in the insulating body. The plurality of receptacle devices have a plurality of inner areas with a plurality of contact elements configured to be opposite corresponding ones of the contact areas on the switching assemblies. The connector includes also: a substrate; a plurality of signal lines configured on or in the substrate; a plurality of contact devices for electrically making contact with the plurality of signal lines; and a plurality of contact connections formed in or at the insulating body and electrically conductively connecting corresponding ones of the plurality of contact elements of at least two of the plurality of receptacle devices to one another.

The inventive connector has contact connections between contact elements of a plurality of receptacle devices (slots) of identical type. Switching assemblies of identical type that are provided in the receptacle devices are then not connected via contact connections on a substrate, generally a main board, but rather by contact connections provided in or at an insulating body of the connector.

In this case the term switching assemblies of identical type refers to those that have a compatible mechanical and electronic interface to the bus system. Switching assemblies of identical type can otherwise differ in multiple respects. If the switching assemblies are memory modules, then the latter may perfectly well have a different internal construction, for instance, with memory chips having a different memory size, but are equipped with a uniform interface for a common bus system (DDRI, DDRII, RAMBUS).

The signal lines of the bus system are led via contact devices of the connector from the substrate to corresponding contact elements of the receptacle devices. The contact elements are mechanically and electrically conductively connected to the contact devices.

Compared with conventional connectors, the length of a signal path between corresponding contact elements of adjacent slots is reduced, as is the number of contact devices via which signals transferred on the signal paths are passed. The result is significantly reduced parasitic line capacitances, line resistances and line inductances (parasitics), and also, due to the reduced number of contact devices, a reduced number of reflection points.

Since each soldering point in the bus system constitutes a potential fault source for an interruption of a signal line or for a short circuit of a signal line with an adjacent signal line, the frequency of faults is also reduced as a result of the greatly reduced number of soldering points. The number of contact areas or plated-through holes is correspondingly reduced on the substrate, so that the configuration (routing) of electrical lines is facilitated there.

The reduction of the line resistance of the signal lines or of the parasitic effects is beneficial particularly in a preferred embodiment of the invention, in which the contact connections are respectively arranged between the corresponding contact elements and connect the latter in the shortest way.

In a series bus system, the bus signals of switching assemblies that are electrically connected in series are looped through from a first switching assembly in a first receptacle device to a last switching assembly or termination in a last receptacle device. In this case, the contact elements of a receptacle device are respectively assigned to an input set or an output set (up-down approach). The bus signals are then passed proceeding from the main board via the contact devices to the contact elements of the input set of the first receptacle device. On the switching assembly arranged in the receptacle device, the bus signals are possibly conditioned and passed to the contact elements of the output set. Via the contact connections, the contact elements of the output sets of the receptacle devices are respectively connected to the contact elements of the input sets of the respectively succeeding receptacle devices. An example of a series bus system for memory modules is the RAMBUS concept.

In contrast, the bus systems for DDRI and DDRII systems are in each case stub bus systems. Proceeding from a main line between a bus control module and an end point with a termination (DDRI) or last insertion location (DDRII), lines branch off to the individual insertion locations. In the case of a stub bus system, in the connector, the contact connections are respectively arranged between the corresponding contact elements of at least a plurality, but preferably all, of the receptacle devices. In this case, the contact devices are provided at the contact elements of at least one receptacle device and are electrically conductively connected to the contact elements. The contact device and the contact element are then usually produced from one piece, for instance, by stamping.

A stub bus system is realized in the connector in this case, and the contact connections form the main line. By using the contact devices, the stub bus system of the connector is connected to the signal lines on the main board.

In a preferred embodiment of the connector, the contact devices are assigned to a single receptacle device. The contact elements of this one receptacle device are then mechanically and electrically conductively connected to the respectively corresponding contact devices, and form a unit.

If required, for instance for DDRI systems, the termination of the stub bus system is also embodied in the connector. In this case, a termination is in each case conductively connected to that end of the contact connections which is opposite to the feeding contact device.

In a particularly preferred embodiment of the connector, both a first and a last receptacle device are assigned contact devices to the substrate and the contact elements of the first and of the last receptacle device are provided with the respectively corresponding contact devices. As a result, the stub bus system is led back to the substrate. The termination is then to be provided on the substrate.

In the case of a connector for a star bus system, the contact devices form a star point at an end oriented toward the contact elements, and the contact connections from the contact elements of the receptacle devices are led to the star point.

If the contact connections between the star point and the contact element are in each case formed essentially with the same length, then leads of identical length, and hence identical signal propagation times, advantageously result for all the receptacle devices connected to the star point. As a consequence, higher clock rates can be realized in such systems.

In a preferred embodiment, the connector for star bus systems has two receptacle devices. In this case, the longitudinal axis of the contact elements and/or the contact connections between the star point and the contact elements are inclined by 45 to 75 degrees with respect to one another and with respect to the longitudinal axis of the contact device, in order to reduce signal reflections at the star point.

Preferably, the contact connections form an angle of essentially 60 degrees at the star point for two receptacle devices formed in the connector.

In a further preferred embodiment, the connector has guides for mechanically stabilizing switching assemblies, which are arranged on expansion modules. These guides are embodied for instance in slot form in the insulating body or include a series of bulges on the insulating body which, as required, also have mechanical fixing or locking devices.

The terminations to be provided for a star bus system are advantageously arranged in or at the insulating body in each case in feeds to the star point, resulting in a particularly effective realization of the terminations. A symmetrical impedance, that is to say an impedance that is independent of a signal direction, advantageously results in the event of an impedance matching at the star point of a star bus system.

In a stub bus system, the signal lines (transmission lines) brought together at a junction point (T point) in each case have an identical impedance of e.g. 50 ohms. At the T point, for signals brought to the T point on one signal line, a parallel circuit formed by the other two signal lines with, in that case, an impedance of 25 ohms is effective in each case, which constitutes a mismatch and leads to reflections. A matching of the impedances at the T point is only ever possible in one direction of the signal transmission.

In the case of a star bus system, a resistance of one third of the line impedance is preferably provided in or at the star point upstream of each signal line. In a 60 ohm environment, an impedance of 60 ohms is always effective independently of the direction of a signal transmission at the star point. The impedance of 60 ohms always results from the addition of the resistance of 20 ohms in the signal-feeding line and a resistance of 40 ohms resulting, for its part, from the parallel circuit including the impedances of the two outgoing signal lines. These impedances respectively are composed of a resistance of 20 ohms and the line impedance of 60 ohms, that is to say together 80 ohms. As a result of the direction-independent impedance matching, the star bus system enables higher data transfer rates.

In this case, the terminations are preferably formed using thin-film technology.

For all of the bus systems mentioned, a particularly advantageous fashioning of the connector results by virtue of an essentially parallel orientation of the receptacle devices, and the receptacle devices in each case are arranged next to one another. In addition, each receptacle device has, as required, customary expert implementations such as coding devices, additional guiding and fixing elements or an ejection mechanism.

A further preferred fashioning of the connector results by forming the contact devices as solder balls for surface mounting, thereby minimizing parasitic effects of the contact devices and significantly simplifying the routing of lines on the main board.

Other features which are considered as characteristic for the invention are set forth in the appended claims.

Although the invention is illustrated and described herein as embodied in a connector for a plurality of switching assemblies with compatible interfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4A is a diagrammatic cross sectional view taken through a third exemplary embodiment of a connector for a star bus system;

FIG. 4B is a plan view of the third exemplary embodiment of a connector for a star bus system;

FIG. 5 is a perspective illustration of two contact elements and a contact connection between the contact elements constructed in accordance with the first exemplary embodiment of the connector;

FIG. 6A is a diagrammatic illustration of a first exemplary embodiment of a contact pin; and FIG. 6B is a diagrammatic illustration of a second exemplary embodiment of the contact pin.

DESCRIPTION OF THE PREFERRED EMBODIMENTS

FIGS. 1 to 4 relate to PC systems whose main memory can be configured by using insertion locations on a main board as slots for memory modules. However, a multiplicity of other designs of the inventive connector disclosed herein will become obvious to one of ordinary skill in the art after reading the instant disclosure.

Figure 2:
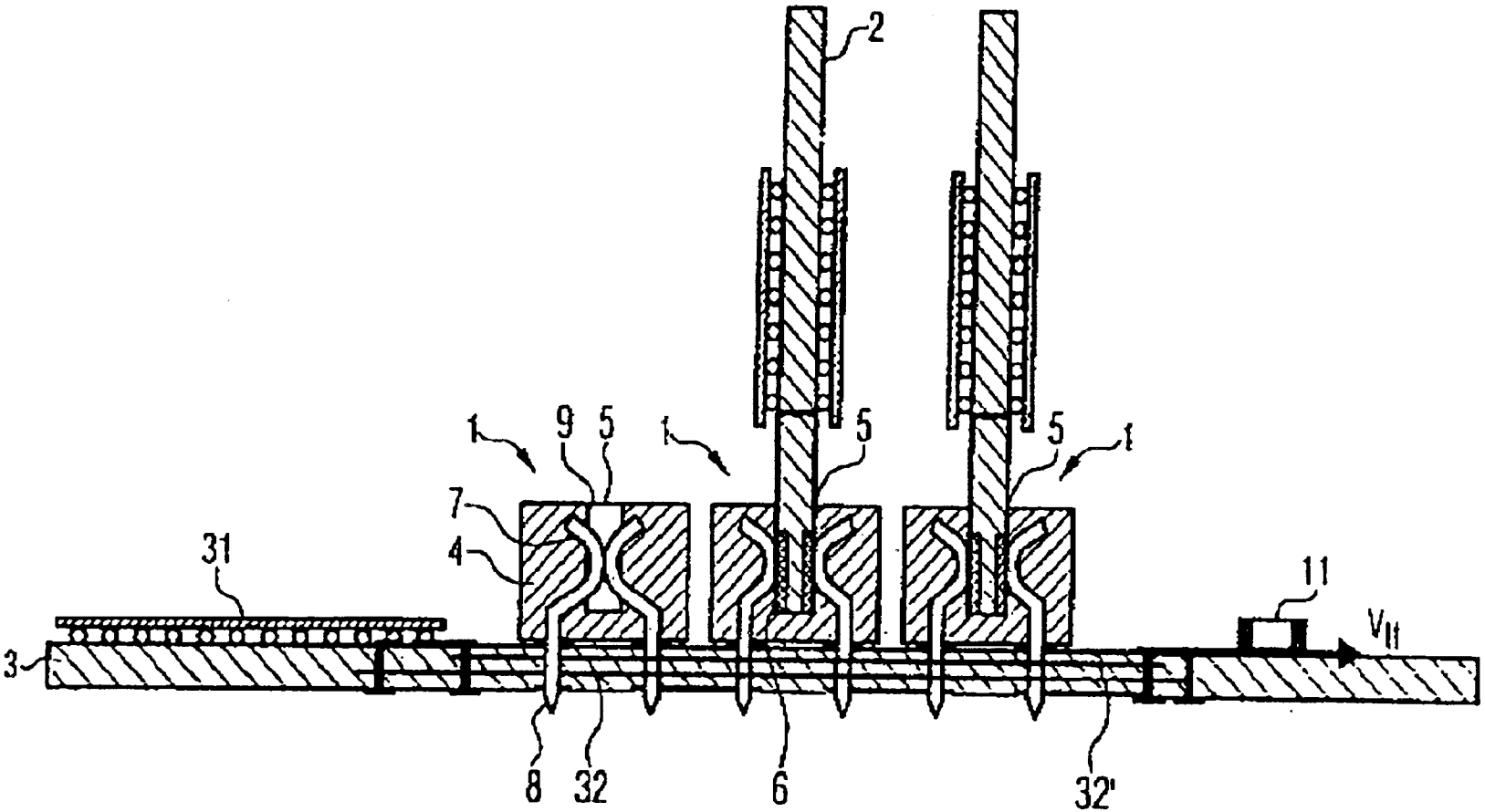
FIG. 2 Prior Art
FIG. 2 is a diagrammatic cross sectional view taken through a configuration with conventional connectors for a stub bus system.

Referring now to the figures of the drawing in detail and first, particularly, to FIG. 2 thereof, there is shown a conventional configuration of a bus control module 31, a plurality of connectors 1, and terminations 11 on a main board serving as substrate 3. The bus control module 31, the connectors 1 and also the terminations 11 are electrically conductively connected to one another via the signal lines 32 of a stub bus system. The connectors 1 respectively have a receptacle device 5, at whose inner areas 9 contact elements 7 are provided. The contact elements 7 are each connected to a corresponding contact device 8 formed as a contact pin in this example. The two right-hand connectors 1 are equipped with switching assemblies 2 having contact areas 6. In the equipped state, in which a switching assembly 2 is arranged in one of the receptacle devices 5, the contact areas 6 are opposite the contact elements 7.

Each of the units formed from in each case one of the contact devices 8 and one of the contact elements 7 constitutes a conductive stub from the main line of the bus system formed by the signal lines 32. This stub has parasitic properties in each case proportional to the total length of the stub. In this respect, the length of the stub determines, by way of the propagation time, a delay of a reflected interference signal relative to an undelayed useful signal.

Figure 1:
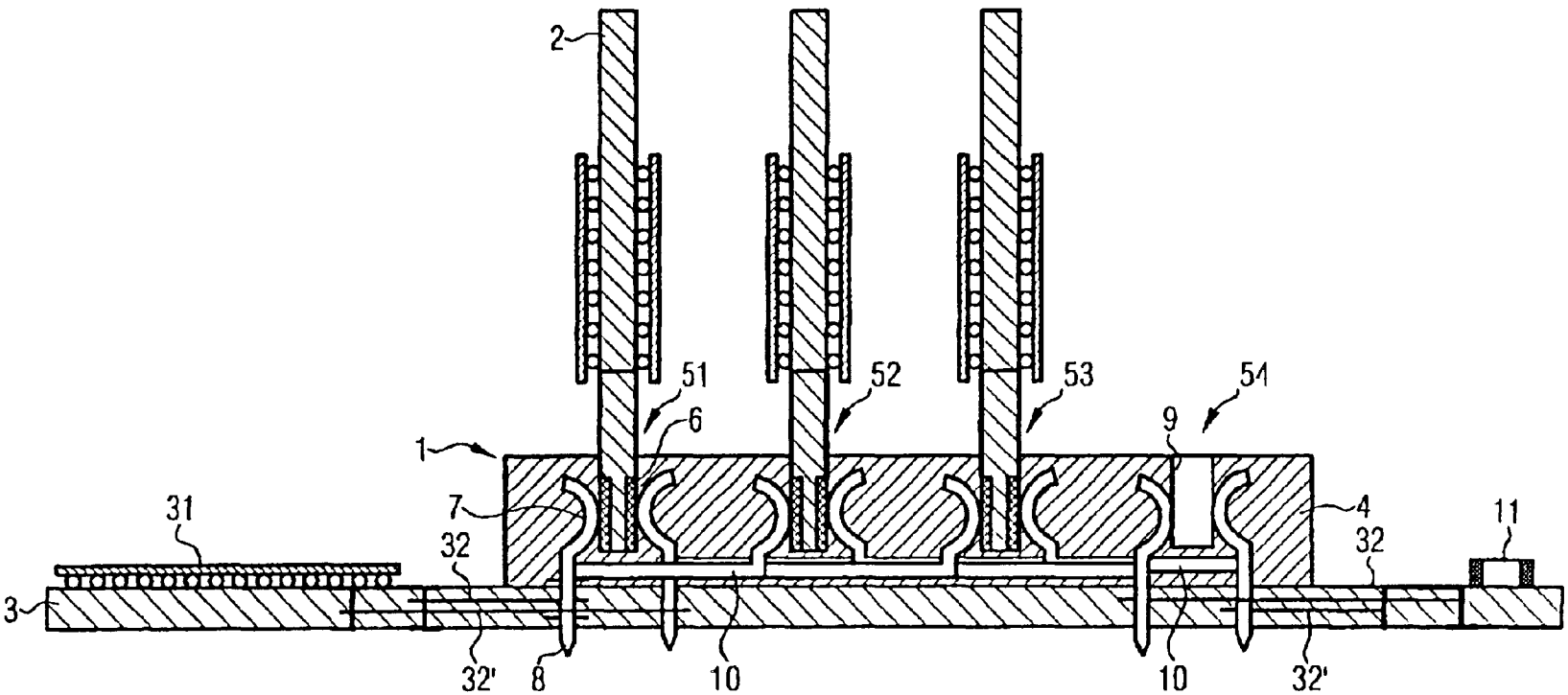
FIG. 1 is a diagrammatic cross sectional view taken through a configuration with a first exemplary embodiment of a connector for a stub bus system.

In contrast, the functionally comparable configuration illustrated in FIG. 1 with an inventive connector 1 has contact connections 10 provided in the insulating body 4 of the connector 1. The contact connections 10 connect respectively corresponding contact elements 7 of the receptacle devices 51, 52, 53 and 54 to one another. Both the contact elements 7 of a first 51 and of a last 54 receptacle device are assigned contact devices 8 for electrically making contact with the signal lines 32 arranged in or on the substrate 3. The contact elements 7 of the first receptacle device 51 and of the last receptacle device 54 form a unit together with the contact devices 8.

The signal lines of the stub bus system are thus integrated into the connector 1 in the form of the contact connections 10. The length of the stubs and thus the effect of reflections is reduced. The length of signal paths between the switching assemblies 2 and thus the signal propagation time differences between the individual switching assemblies 2 are likewise reduced. The probability of defective connections between the connector 1 and the substrate 3 is reduced by virtue of the reduced number of soldering points required between the substrate 3 and the receptacle devices 51-54. On the substrate 3, there remains significantly more space for electrical lines below the connector 1, thereby facilitating the configuration of lines on the substrate 3.

Figure 3:
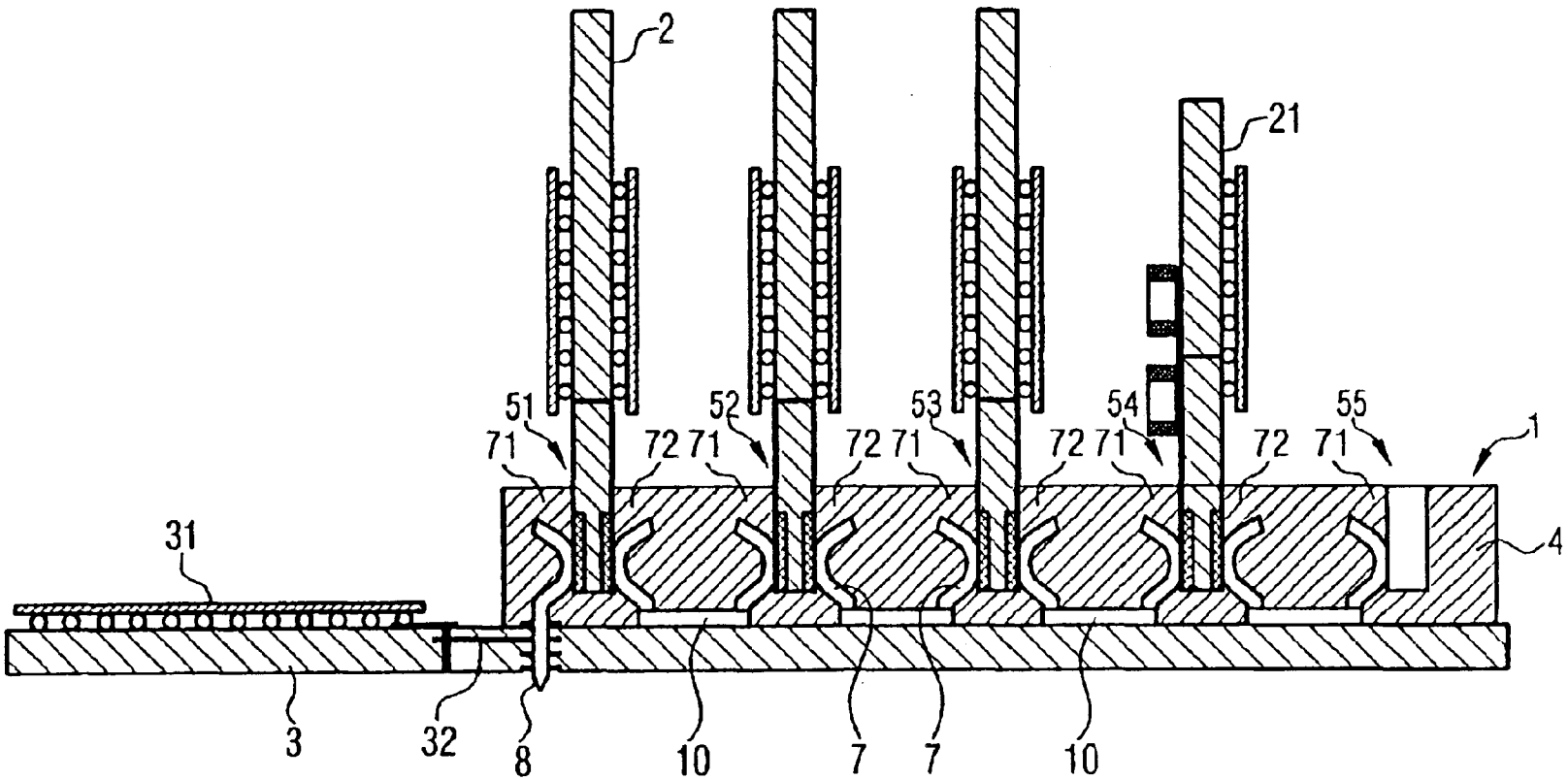
FIG. 3 is a diagrammatic cross sectional view taken through a configuration with a second exemplary embodiment of a connector for a series bus system (up/down approach)

In FIG. 3, the bus control module 31 and the switching assemblies 2 are connected via a series bus system (up/down approach). The contact connections 10 in each case connect only two contact elements 7. In each case, one contact element 7 is assigned to an output set 72 of contact elements 7 of a receptacle device 51, 52, 53, 54 and the other contact element 7 is assigned to an input set 71 of a succeeding receptacle device 52, 53, 54, 55. The series bus system requires a termination module 21 in the respectively last equipped receptacle device 54.

An inventive connector for a star bus system is illustrated in cross section in FIG. 4A and in plan view in FIG. 4B. In this case, an insulating body 4 has contact devices 8 at a surface facing the substrate 3. The receptacle devices 51, 52 are of slot-like design and are inclined by about 60 degrees with respect to one another and with respect to a surface of the main board. A contact device 8, two corresponding contact elements 7, and a contact connection 10 in each case form a contact pin 13. An identical connection length between a star point 12 and a contact region 70 on the two corresponding contact elements 7 advantageously results for each contact pin 13. Furthermore, symmetrical attenuation properties and reflection points that are independent of a signal direction of a signal are present in each case. This means that, for all the bus signals, identical signal propagation times from and to a bus control module result for switching assemblies 2 arranged in the receptacle devices 51, 52, thereby enabling an increased clock rate compared with conventional connectors.

Moreover, the insulating body 4 has stabilization devices 15 for the mechanical stabilization of switching assemblies 2 arranged on expansion modules.

Further cutouts 16 on a mounting area facing the substrate 3 enable the configuration of terminations 11 on the substrate 3 in the region below the connector 1.

FIG. 5 illustrates two pairs of contact elements 7, 7' respectively connected by a contact connection 10. In this case, the contact elements 7, 7' respectively assigned to a common receptacle device 5 are opposite one another in an offset manner at the receptacle device 5.

FIG. 6A illustrates a contact pin 13 for a star bus system. A first embodiment of the contact pin 13 has functional sections including a contact device 8, contact elements 7 with contact regions 70, a contact connection 10 and star point 12. In this case, the contact pin 13 can be produced in one piece by customary means, for instance by stamping.

A second embodiment of the contact pin 13 is shown in FIG. 6B. In this case, the star point 12 is formed as an auxiliary substrate 14. The auxiliary substrate 14, which in this case is oriented parallel to the substrate 3, may also be arranged perpendicular to the latter. Terminations (star resistors) are provided on or in the auxiliary substrate 14. If the auxiliary substrate 14 is formed as a ceramic substrate, then the terminations are realized using thick-film technology. If the auxiliary substrate 14 is formed as a circuit board (PCB), then the terminations are formed as SMD (surface mounted devices) or as buried resistors.

We claim:

1. A connector for fixing and making contact with switching assemblies having contact areas and mutually compatible interfaces, comprising:

an insulating body;

a plurality of receptacle devices for configuring the switching assemblies, said plurality of receptacle devices formed in said insulating body, said plurality of receptacle devices having a plurality of inner areas with a plurality of contact elements configured to be opposite corresponding said contact areas on the switching assemblies;

a substrate;

a plurality of signal lines configured on or in said substrate;

a plurality of contact devices for electrically making contact with said plurality of signal lines; and a plurality of contact connections formed in or at said insulating body and electrically conductively connecting corresponding ones of said plurality of contact elements of at least two of said plurality of receptacle devices to one another;

at least one of said plurality of contact devices having a star point;

a first one of said plurality of contact connections being connected to a first one of said plurality of contact elements;

a second one of said plurality of contact connections being connected to a second one of said plurality of contact elements;

said first one of said plurality of contact connections and said second one of said plurality of contact connections being led to said star point;

said first one of said plurality of contact connections having a length between said star point and said first one of said plurality of contact elements;

said second one of said plurality of contact connections having a length between said star point and said second one of said plurality of contact elements;

said length of said first one of said plurality of contact connections being substantially identical to said length of said second one of said plurality of contact connections;

ones of said plurality of contact elements being offset substantially between 45 and 75 degrees with respect to an orientation of said plurality of contact devices.

2. The connector according to claim 1, wherein said first one of said plurality of contact connections and said second one of said plurality of contact connections are offset essentially between 45 and 75 degrees with respect to an orientation of said plurality of contact devices.

3. The connector according to claim 1, wherein said plurality of receptacle devices are configured next to one another in parallel.

* * * * *